US008083854B2

(12) United States Patent
Cirette

(10) Patent No.: US 8,083,854 B2
(45) Date of Patent: Dec. 27, 2011

(54) VACUUM PUMPING CIRCUIT AND MACHINE FOR TREATING CONTAINERS EQUIPPED WITH SAME

(75) Inventor: Damien Cirette, Octeville sur Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 1083 days.

(21) Appl. No.: 11/631,149

(22) PCT Filed: Jun. 27, 2005

(86) PCT No.: PCT/EP2005/052985

§ 371 (c)(1),
(2), (4) Date: Feb. 23, 2007

(87) PCT Pub. No.: WO2006/010679

PCT Pub. Date: Feb. 2, 2006

(65) Prior Publication Data

US 2007/0248479 A1 Oct. 25, 2007

(30) Foreign Application Priority Data

Jun. 30, 2004 (FR) ..... 04 51366

(51) Int. Cl.
*C23C 16/00* (2006.01)

(52) U.S. Cl. ..... 118/715; 118/723 MW

(58) Field of Classification Search ..... 118/715, 118/722, 723 R, 723 MW; 156/345.41, 345.42
See application file for complete search history.

(56) References Cited

U.S. PATENT DOCUMENTS 3,446,422 A * 5/1969 Bailleul-Langlais et al. .. 417/48
4,782,886 A * 11/1988 Uchida et al. ..... 164/305
6,037,562 A 3/2000 Awakowicz et al.
6,328,805 B1 * 12/2001 Rius ..... 118/715
6,478,043 B2 * 11/2002 Ishigaki ..... 137/341

* cited by examiner

*Primary Examiner* — Maureen Gramaglia
(74) *Attorney, Agent, or Firm* — Young & Thompson

(57) ABSTRACT

The invention relates to a vacuum pumping circuit comprising: an upper chamber (34) and a lower chamber (36) that communicate via a connecting orifice (38), and comprising a valve (40) provided with a stem guided so as to slide along a vertical axis (A1) in order to close the connecting orifice (38), which circuit is characterized in that the valve stem (48) is provided with a section forming a piston (52) which constitutes the mobile upper wall of a control chamber (54) communicating with the upper chamber (34), the piston (52) having an upper face (56) at atmospheric air pressure and a lower face (58) on which the pressure is that present in the control chamber (54).

9 Claims, 4 Drawing Sheets

VACUUM PUMPING CIRCUIT AND MACHINE FOR TREATING CONTAINERS EQUIPPED WITH SAME

The present invention relates to a vacuum pumping circuit and a machine for treating containers, such as bottles.

The present invention relates more particularly to a vacuum pumping circuit for a machine for treating containers by depositing an internal barrier coating by means of a microwave-generated plasma, comprising:

an upper chamber and a lower chamber that communicate via a connecting orifice, the lower chamber being connected to a cavity and the upper chamber to a vacuum pump designed to evacuate the cavity until the pressure in the cavity reaches a specified value termed the final value, and comprising a valve guided in a sliding manner along an essentially vertical axis in a corresponding opening in the upper transverse wall of the upper chamber, between a closed lower axial position, in which the valve head closes the connecting orifice, and an open upper axial position, of the type in which the valve has a stem that passes axially up out of the upper chamber, the valve stem being connected to means capable of moving the valve at least to its open position.

To keep the valve closed, e.g. while treating a container by depositing the internal coating, it is known practice to use a helical compression spring that urges the valve axially to its closed position.

This approach is not completely satisfactory because the spring has problems of reliability. Sometimes, for example, the spring breaks under the mechanical stresses to which it is subjected.

In the case of a pumping circuit fitted to a treatment station arranged on a revolving carousel, it is also known practice to keep the valve closed by means of a cam system, using for example a roller connected to the valve stem, and a fixed control surface.

This approach is also not completely satisfactory because it necessitates a very long control surface, as well as accurate fitting to make the closure leaktight. Moreover, wear of the roller or control surface can adversely affect the leaktightness of the valve.

It is a particular object of the present invention to solve these problems.

To this end, the invention provides a vacuum pumping circuit of the type described above, characterized in that the valve stem is provided with a section forming a piston which constitutes the mobile upper wall of a control chamber communicating with the upper chamber, the piston having an upper face permanently at atmospheric air pressure and a lower face on which the pressure is that present in the control chamber, in such a way that when the pressure in the lower chamber reaches the final value, the valve is kept closed by the action of the pressure differential across the two faces of the piston.

Other Features of the Invention are as Follows:

the upper transverse wall comprises an annular spacer which: is fitted axially between the opening and the control chamber; comprises a central duct for the axial guidance of the valve stem; and is provided with channels connecting together the control chamber and the upper chamber;

a vacuum-proof metal bellows is interposed axially between the outer peripheral edge of the piston and the outer peripheral edge of an axial section of the spacer so as to form the outer peripheral wall of the control chamber around the valve stem;

the valve has an axial skirt that is connected to and slides axially with the valve stem and that surrounds the bellows and the piston;

the upper end section of the valve stem is acted upon by means, such as a cam mechanism, in such a way as to slide the valve to its open position;

the cam mechanism has a control surface that controls the movement of the valve to its closed position;

the valve head is fixed to the lower end of the valve stem;

the connecting orifice comprises an upper transverse shoulder, and the valve head comprises a lower transverse closing surface that is provided with an annular seal and that is designed to make leaktight axial contact with the transverse shoulder when the valve is occupying its closed position.

The invention also provides a machine for treating containers, particularly bottles, by depositing an internal barrier coating by means of a microwave-generated plasma, notably for the purpose of packaging oxidation-sensitive liquids in the containers, comprising at least one treatment station for a container, each treatment station comprising:

a treatment enclosure designed to contain the container and defining a cavity around the container, and a lid designed to close the enclosure hermetically and having a pumping passage connected leaktightly to the interior of the container, which machine is characterized in that the lid is equipped with a pumping circuit having one of the preceding features, in that the lower chamber is connected leaktightly to the cavity defined by the enclosure, and in that the upper chamber is connected to the pumping passage.

Other features and advantages of the invention will become apparent on reading the following detailed description, for an understanding of which the reader should refer to the appended drawings, in which.

In the description which follows, identical, similar, or analogous parts will be given the same reference numbers.

Figure 1:
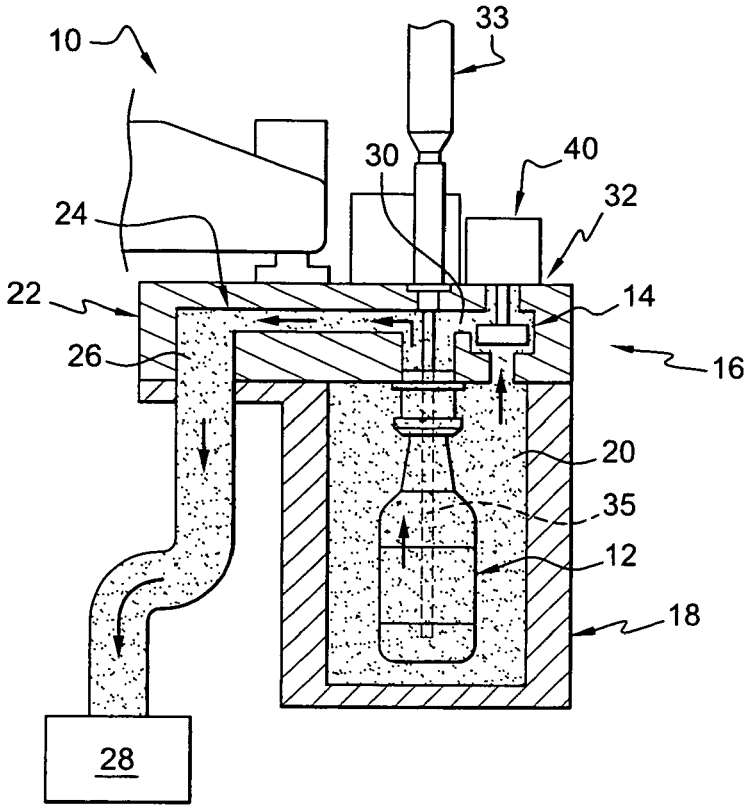
FIG. 1 is an axial cross section showing schematically a treatment station of the machine equipped with a vacuum pumping circuit made in accordance with the teachings of the invention, in a first pumping phase.
Figure 2:
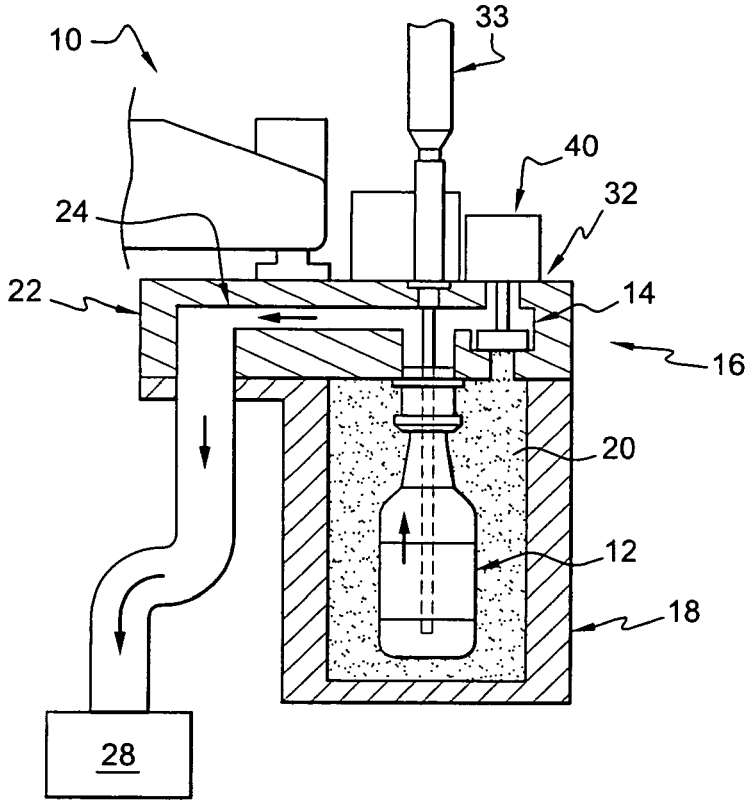
FIG. 2 is a view similar to FIG. 1 showing the treatment station in a second pumping phase.

FIGS. 1 and 2 show part of a machine 10 for treating containers 12, here shown in the form of bottles. The machine is equipped with a vacuum pumping circuit 14 made in accordance with the teachings of the invention.

The purpose of the machine 10 is to deposit an internal barrier coating by means of a microwave-generated plasma, notably for the purpose of packaging an oxidation-sensitive liquid in the containers 12.

As in the prior art, the machine 10 has several treatment stations 16 which can be arranged circumferentially at regular intervals around a revolving carousel (not shown), each treatment station 16 being designed to treat one container 12 at a time.

The figures show part of a single treatment station 16.

The treatment station 16 comprises a treatment enclosure 18 designed to contain the container 12 and defining a cavity 20 around the container 12.

Here, the container 12 is arranged vertically with its opening uppermost.

The treatment station 16 also comprises a lid 22 designed to close the enclosure 18 hermetically in such a way as to define the top of the cavity 20. The lid 22 comprises a pumping passage 24 connected leaktightly to the interior of the container 12.

The pumping passage 24 is connected, at a first end 26, to a vacuum pump 28.

The second end 30 of the pumping passage 24 communicates with the cavity 20 of the treatment enclosure 18 through a connecting portion 32 which is arranged here in an end portion of the lid 22.

The lid 22 also has an injector 33 for a precursor gas, such as acetylene in the case of a carbon-containing deposition, which injector is fitted with an injector tube 35 extending axially into the container 12.

Figure 3:
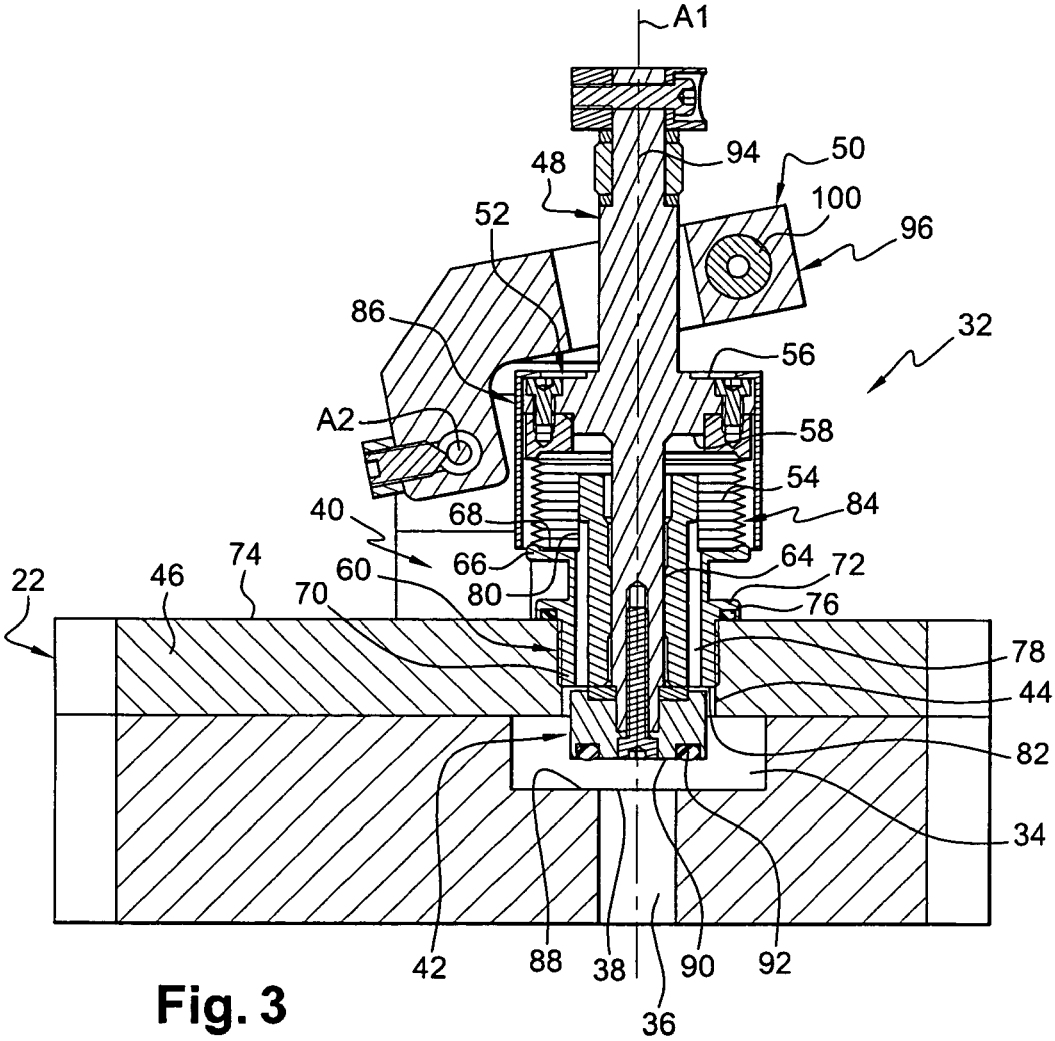
FIG. 3 is an axial cross section showing schematically a connecting portion of the vacuum pumping circuit equipped with a valve occupying its open axial position.
Figure 4:
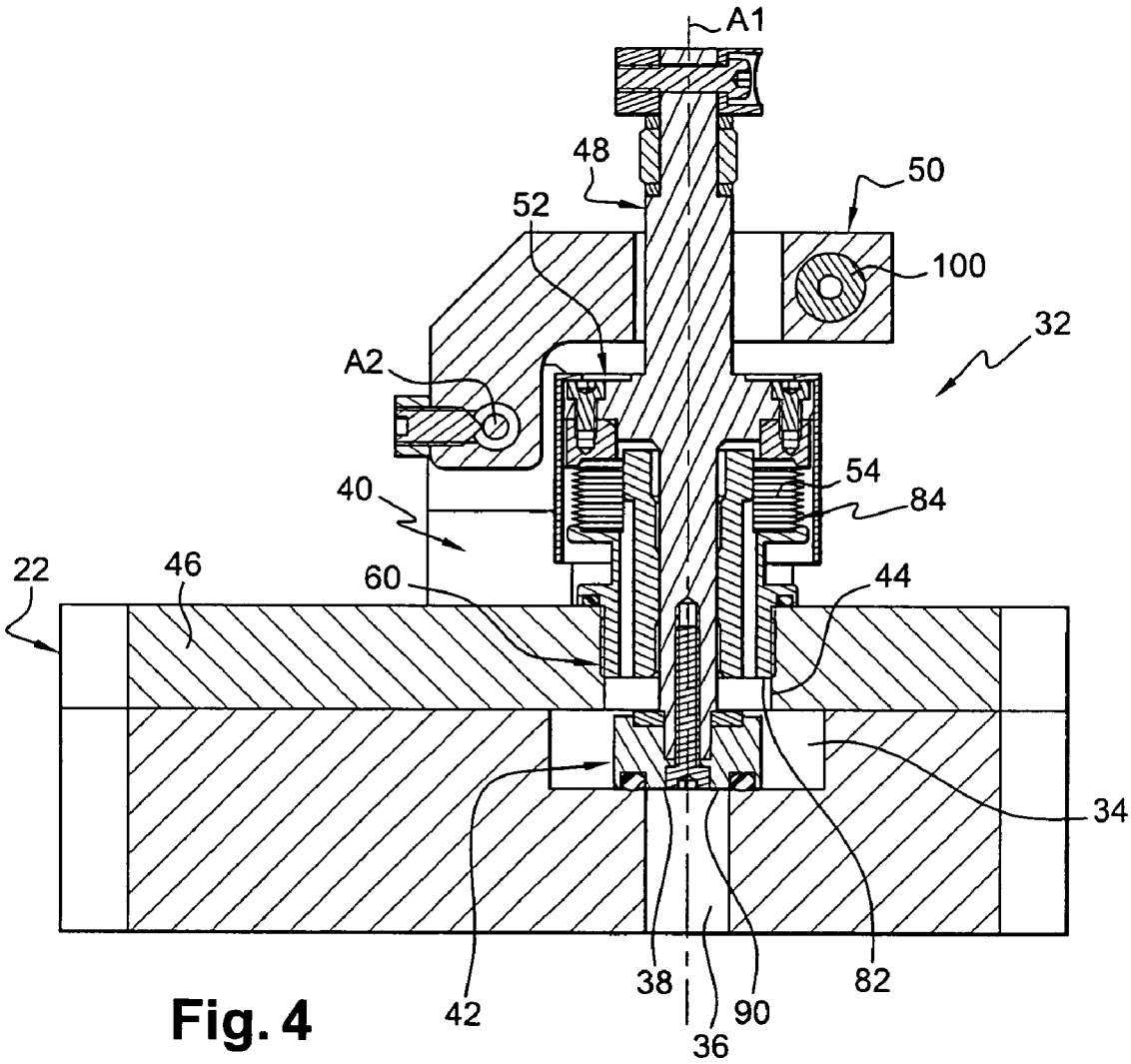
FIG. 4 is a view similar to FIG. 3 which shows the valve in the closed axial position.
Figure 5:
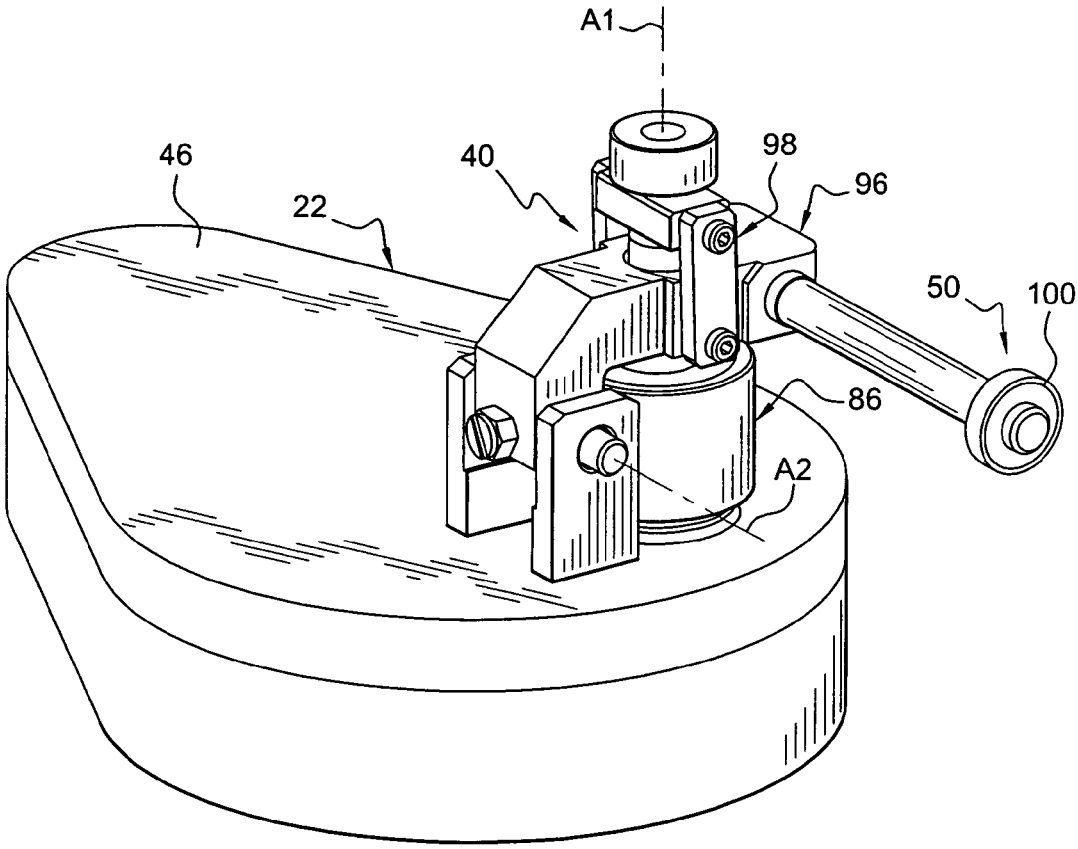
FIG. 5 is a perspective view showing schematically the lid equipped with the valve as per the teachings of the invention when occupying its closed position.

The connecting portion 32 is illustrated in more detail in FIGS. 3 and 4.

The connecting portion 32 of the vacuum pumping circuit 14 comprises an upper chamber 34 and a lower chamber 36, which communicate via a connecting orifice 38.

In the embodiment shown here, the lower chamber 36 is connected to the cavity 20 defined by the treatment enclosure 18 and the upper chamber 34 is connected to the pumping passage 24 at the second end 30.

The connecting portion 32 comprises a valve 40 which is guided in a sliding manner along an essentially vertical axis A1, between a closed lower axial position shown in FIGS. 2 and 4, where the valve 40 head 42 closes the connecting orifice 38, and an open upper axial position shown in FIGS. 1 and 3.

In the rest of the description, a vertical axial orientation is defined, without implying any limitation, as being on the axis A1 on which the valve 40 slides. Where elements are qualified by the adjective "transverse", it will be with reference to this axis A1.

The valve 40 slides in a corresponding opening 44 in the upper transverse wall 46 of the upper chamber 34.

The upper transverse wall 46 consists here of the upper transverse wall of the lid 22.

The valve 40 has a stem 48 which extends axially up out of the upper chamber 34 and is connected to means 50 capable of sliding the valve 40 at least to its open position.

By the teachings of the invention, the stem 48 is provided with a section forming a piston 52 which constitutes the mobile upper wall of a control chamber 54 communicating with the upper chamber 34.

The piston 52 here is generally cylindrical and coaxial with the stem 48 and is made in one piece with the stem 48.

The piston 52 comprises a transverse upper face 56 which is permanently at atmospheric air pressure, and a lower face 58, also extending transversely, on which the pressure is that present in the control chamber 54.

The upper transverse wall 46 advantageously comprises an annular spacer 60 fitted axially between the opening 44 and the control chamber 54.

The spacer 60 has a generally cylindrical tubular main body, through which a central passage 64 runs axially from its lower end to its upper end.

The step 48 is guided axially by the internal axial walls of the central passage 64.

The spacer 60 comprises an upper portion 66, in the form of a radial collar whose upper transverse face 68 is oriented axially toward the lower face 58 of the piston 52 in such a way as to axially define the control chamber 54.

The lower end section 70 of the spacer 60 is here screwed into the opening 44 until a lower radial collar 72 on the spacer 60 makes leaktight axial contact with the upper face 74 of the upper transverse wall 46.

The lower radial collar 72 is provided here with an "O" ring 76 interposed axially between the lower radial collar 72 and the upper transverse wall 46.

The spacer 60 is provided with axial channels 78 formed within its radial thickness to connect together the control chamber 54 and the upper chamber 34.

Each axial channel 78 is a through channel running from the outer axial face 80 of the upper end section of the spacer 60 to the transverse lower end face 82 of the spacer 60.

A vacuum-proof metal bellows 84 is advantageously interposed axially between the outer peripheral edge of the lower face 58 of the piston 52 and the outer peripheral edge of the radial collar forming the upper portion 66 of the spacer.

The bellows 84 is coaxial with the stem 48 and forms the outer peripheral wall of the control chamber 54 around the stem 48.

The valve 40 preferably has an axial skirt 86 that is connected to and slides axially with the stem 48 and that surrounds the bellows 84 and the piston 52.

The valve 40 head 42 here is cylindrical and it is fixed to the lower end of the stem 48.

The connecting orifice 38 here comprises an upper transverse shoulder 88.

The valve 40 head 42 comprises a lower transverse closing surface 90 that is provided with an annular seal 92 and that is designed to make leaktight axial contact with the transverse shoulder 88 when the valve 40 is occupying its closed position, as shown in FIGS. 2 and 4.

Preferably, as shown in the figures, the means 50 capable of sliding the valve 40 at least to its open position take the form of a cam mechanism 50 that acts on the upper end section 94 of the stem 48 in such a way as to slide the valve 40 to its open position and that moves the valve 40 to its closed position.

The cam mechanism 50 here comprises a lever 96 which is pivoted to the lid 22 about a transverse axis A2.

The pivoting of the lever 96 is connected to the sliding of the valve 40 by a set of links 98.

A roller 100 on the lever 96 is designed to be acted upon by a control surface (not shown) of the machine 10.

The control surface comprises a number of sections designed to pivot the lever 96 and move the valve 40 appropriately to either of its two extreme axial positions.

The operation of the machine 10 and of the vacuum pumping circuit 14 with which it is equipped will now be described.

The method of treating the container 12 using the machine 10 comprises a preliminary step in which the vacuum pumping circuit 14 reduces the pressure in the cavity 20 to a specified value termed the final external value $pF_{ext}$ and that in the container 12 to a specified value termed the final internal value $pF_{int}$.

The final internal value $pF_{int}$ is generally approximately 0.1 mbar and the final external value $pF_{ext}$ is approximately 50 mbar, so that the vacuum in the container 12 is higher than that in the cavity 20.

The preliminary step is followed by a treating step in which the final values $pF_{ext}$, $pF_{int}$ are maintained in the cavity 20 and in the container 12 to allow the deposition of the internal coating inside the container 12.

In the course of the treating step, the precursor gas is injected into the container 12 through the injector 33 and subjected to the action of microwaves in order to turn it into a plasma and cause deposition of the barrier coating (which is carbon-containing if the precursor is acetylene-based) on the inside walls of the container 12. This deposition creates an internal coating which forms a barrier, for example to molecular oxygen and carbon dioxide molecules.

The preliminary step involves a first phase, illustrated in FIG. 1, in which both the cavity 20 and the container 12 are pumped out, and a second phase, illustrated in FIG. 2, in which only the container 12 is pumped out.

The first phase ends when the pressure in the cavity 20 reaches the final external value $pF_{ext}$.

During the first phase the pressure reduces in the vacuum pumping circuit 14, particularly in the upper chamber 34 which communicates with the control chamber 54.

The pressure in the control chamber 54 therefore reduces simultaneously, and this creates a pressure differential between the upper face 56 and the lower face 58 of the piston 52, since the upper face 56 is exposed to the atmospheric pressure outside of the vacuum pumping circuit 14.

An axial contact force resulting from this pressure differential therefore merges the valve 40 axially downward.

The cam mechanism 50 keeps the valve 40 open until the pressure in the cavity 20 reaches its final external value $pF_{ext}$.

As the pressure in the cavity 20 approaches the final external value $pF_{ext}$, the cam mechanism 50 controls the movement of the valve 40 so that it descends gradually to its closed position (FIGS. 2 and 4).

When the valve 40 occupies its closed position, the second phase of the preliminary step is begun.

During the second phase the vacuum pumping circuit 14 continues to pump out the container 12 only, until the final internal value $pF_{int}$ is reached, this being less than the pressure in the cavity 20.

At the end of the second phase the treating step can be carried out.

During the treating step the vacuum is maintained in the cavity 20 by the hermetic closure of the enclosure 18, and in the container 12 by a continuous and regulated pumping by means of the vacuum pump 28.

At the end of the treating step the interior of the container 12 and the cavity 20 are brought back to atmospheric pressure.

For this purpose the cam mechanism 50 opens the valve 40.

Notice that, during the second phase of the preliminary step and during the treating step, the valve 40 does not require any action from the cam mechanism 50 or from some elastic return means in order to be kept axially in its closed position because the valve 40 is kept closed by the sole action of the pressure differential across the two faces of the piston 52.

The invention claimed is:

1. A vacuum pumping circuit (14) for a machine for treating containers (12) by depositing an internal barrier coating by means of a microwave-generated plasma, comprising:

an upper chamber (34) and a lower chamber (36) that communicate via a connecting orifice (38), the lower chamber (36) being connected to a cavity (20) and the upper chamber (34) to a vacuum pump (28) designed to evacuate the cavity (20) until the pressure in the cavity (20) reaches a specified value termed the final value ($pF_{ext}$), and a valve (40) guided in a sliding manner along an essentially vertical axis (A1) in a corresponding opening (44) in the upper transverse wall (46) of the upper chamber (34), between a closed lower axial position, in which the valve head (42) of the valve (40) closes the connecting orifice (38), and an open upper axial position, the valve (40) having a valve stem (48) that extends axially up out of the upper chamber (34), the valve stem (48) being connected to means (50) for moving the valve (40) at least to its open position, wherein the valve stem (48) is provided with a section forming a piston (52) which constitutes the mobile upper wall of a control chamber (54) communicating with the upper chamber (34), the piston (52) having an upper face (56) permanently at atmospheric air pressure and a lower face (58) on which the pressure is that present in the control chamber (54), in such a way that when the pressure in the lower chamber (36) reaches the final value ($pF_{ext}$), the valve (40) is kept closed by the action of the pressure differential across the two faces (56, 58) of the piston (52), and wherein the upper transverse wall (46) comprises an annular spacer (60) that is fitted axially between the opening (44) and the control chamber (54), and open channels (78) extending axially through said annular spacer (60) with, at one distal end of the open channels, an opening to the control chamber (54) and, at an opposite distal end, an opening to the upper chamber (34), the open channels isobarically connecting together the control chamber (54) and the upper chamber (34).

2. The vacuum pumping circuit (14) as claimed in claim 1, wherein the upper transverse wall (46) comprises a central passage (64) for the axial guidance of the valve stem (48).

3. The vacuum pumping circuit (14) as claimed in claim 2, further comprising a vacuum-proof metal bellows (84) interposed axially between the outer peripheral edge of the piston (52) and the outer peripheral edge of a portion (66) of the spacer (60) so as to form the outer peripheral wall of the control chamber (54) around the valve stem (48).

4. The vacuum pumping circuit (14) as claimed in claim 3, wherein the valve (40) has an axial skirt (86) that is connected to and slides axially with the valve stem (48) and that surrounds the bellows (84) and the piston (52).

5. The vacuum pumping circuit (14) as claimed in claim 1, wherein the means (50) for moving the valve (40) at least to its open position is a cam mechanism (50) that acts on the upper end section of the valve stem (48) in such a way as to slide the valve (40) to its open position.

6. The vacuum pumping circuit (14) as claimed in claim 5, wherein the cam mechanism (50) has a control surface that controls the movement of the valve (40) to its closed position.

7. The vacuum pumping circuit (14) as claimed in claim 1, wherein the valve head (42) is fixed to the lower end of the valve stem (48).

8. The vacuum pumping circuit (14) as claimed in claim 1, wherein the connecting orifice (38) comprises an upper transverse shoulder (88), and in that the valve (40) head (42) comprises a lower transverse closing surface that is provided with an annular seal (92) and that is designed to make leak-tight axial contact with the transverse shoulder (88) when the valve (40) is occupying its closed position.

9. A machine (10) for treating containers (12) by depositing an internal barrier coating by means of a microwave-generated plasma comprising at least one treatment station (16) for a container (12), each treatment station (16) comprising:

a treatment enclosure (18) designed to contain the container (12) and defining a cavity (20) around the container (12); and a lid (22) designed to close the enclosure (18) hermetically and having a pumping passage (24) connected leak tightly to the interior of the container (12), wherein the lid (22) is equipped with the vacuum pumping circuit (14) as claimed in claim 1, the lower chamber (36) is connected leak tightly to the cavity (20) defined by the enclosure (18), and the upper chamber (34) is connected to the pumping passage (24).

* * * * *